United States Patent [19]

Antonious

[11] Patent Number: 4,915,386

[45] **Date of Patent: * Apr. 10, 1990**

[54] PERIMETER WEIGHTED IRON TYPE GOLF CLUB HEAD WITH CENTRALLY LOCATED COMPLEMENTARY WEIGHT

[76] Inventor: Anthony J. Antonious, 205 E. Joppa Rd., Towson, Md. 21204

[ * ] Notice: The portion of the term of this patent subsequent to Mar. 13, 2007 has been disclaimed.

[21] Appl. No.: 261,884

[22] Filed: Oct. 25, 1988

[51] Int. Cl.[4] ..... A63B 53/04

[52] U.S. Cl. ..... 273/167 F; 273/169; D21/220

[58] Field of Search ..... 273/167–175, 273/77 R, 77 A, 162 R; D21/214–220

[56] References Cited

U.S. PATENT DOCUMENTS

| | | | |
|---|---|---|---|
| D. 95,819 | 6/1935 | Gourlay | D21/220 |
| D. 104,495 | 6/1937 | Gallagher | D21/220 |
| D. 165,458 | 12/1951 | Jacobs | D21/220 |
| D. 256,264 | 8/1980 | Solheim | D21/220 |
| D. 298,643 | 11/1988 | Mitsui | D21/220 |
| 1,320,163 | 10/1919 | Maurice | 273/171 |
| 2,087,685 | 7/1937 | Hackney | 273/167 F |
| 3,814,437 | 6/1974 | Winquist | 273/167 R |
| 4,326,326 | 4/1982 | MacDonald | 273/169 |
| 4,345,763 | 8/1982 | Swanson | 273/169 |
| 4,715,601 | 12/1987 | Lamanna | 273/80.2 |

OTHER PUBLICATIONS

Dennis, Larry *Golf Digest,* 1979, p. 117, Photo of Butch Baird's Irons.

MacGregor, *Golf Digest,* 1988, Add for RPM Clubs.

Walter Hagen, *Golf Digest,* 1977, p. 72 Add for Ultradyne III Fore-Weighted Club.

*Primary Examiner*—Edward M. Coven
*Assistant Examiner*—Sebastiano Passaniti
*Attorney, Agent, or Firm*—N. J. Aquilino

[57] ABSTRACT

A perimeter weighted iron type golf club head having a recess or cavity back and peripheral mass with an improved weight configuration formed of a raised concentrated mass weight member within the cavity and located at the center of percussion of the golf club head.

3 Claims, 1 Drawing Sheet

PERIMETER WEIGHTED IRON TYPE GOLF CLUB HEAD WITH CENTRALLY LOCATED COMPLEMENTARY WEIGHT

BACKGROUND OF THE INVENTION

The present invention relates to perimeter weight golf club heads and, more particularly, to recessed or cavity back iron type perimeter weighted golf club heads having an improved weight distribution configuration.

Early iron type golf club heads were essentially flat and had equal weight and mass distribution. Various attempts have been made to maximize weight distribution of golf club heads including locating the majority of the weight at the heel and toe locations of the club head, the bottom of the club head and around the periphery of the club head. Most peripheral weighted golf club heads in use today are made with a deep recess cavity formed in the back of the club head.

Many of the peripheral weighted club head designs in use today generally provide better shot execution when a golf ball is miss hit off the center of percussion, but often there is a sacrifice of accuracy and feel when a ball is hit at the center of percussion because of the lack of sufficient weight in that area. A particular shortcoming of this type of golf club head is a loss of feel and/or control when a ball is miss-hit off of the precise center of percussion.

SUMMARY OF THE INVENTION

The present invention provides an improved golf club head having the advantages of peripheral weighted golf club heads and which also enhances the shot making ability of the club head when a ball is struck at the precise center of percussion.

The present invention provides a perimeter weighted golf club head wherein a peripheral mass is provided thereby forming a cavity recess in the back of the club head and further includes a raised concentrated mass, which may be in the form of a cylinder, semi-hemisphere, oval or other raised shapes located within the cavity in back of and extending outwardly from the center of percussion of the club head. This arrangement provides a more solid feel when a golf ball is struck directly at the center of percussion, thereby producing greater accuracy and improved feel and permitting the golf balls to travel further and straighter with a more productive trajectory.

Among the objects of the present invention are to provide a peripheral weighted iron type golf club head which permits a golfer to achieve improved feel, control, accuracy and distance. Another object is to provide an iron type golf club head that produces a more accurate flight of a golf ball when it is hit at the precise center of percussion on the golf club head.

These and other objects will become apparent with reference to the accompanying drawings and following specification which illustrate the embodiments of the invention.

DESCRIPTION OF THE PREFERRED EMBODIMENTS

Figure 1:
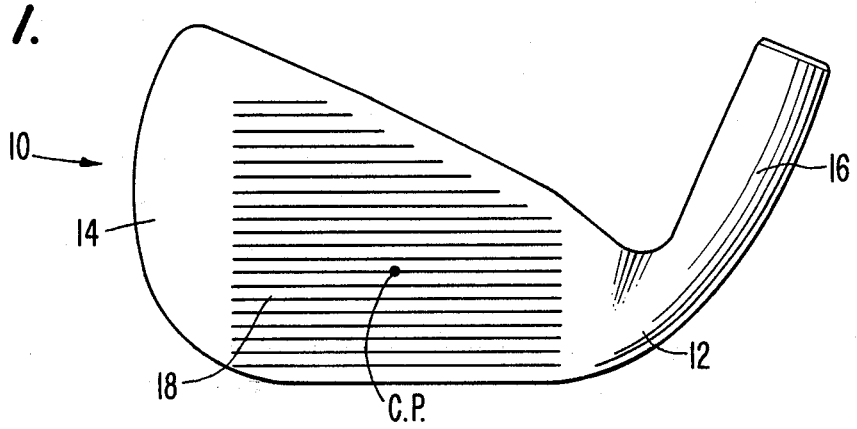
FIG. 1 illustrates a front perspective view of a golf club head in accordance with the present invention.

Referring to the drawings, the preferred embodiments of the present invention are illustrated. Wherever possible, the same or like reference numbers will be used throughout the drawings to refer to the same or like parts.

Figure 2:
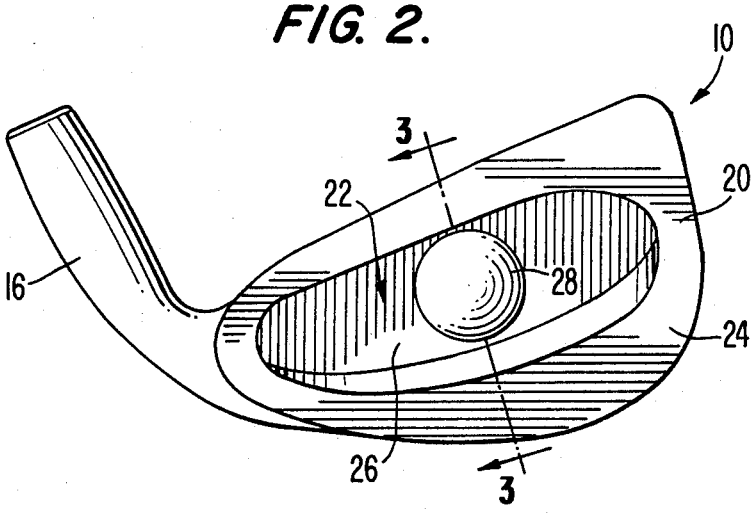
FIG. 2 is a rear perspective view of the golf club head of FIG. 1.
Figure 3:
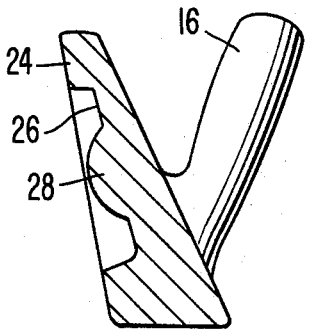
FIG. 3 is a side sectional view taken along the line 3—3 of FIG. 2.

FIGS. 1 to 3 illustrate one embodiment of a golf club head 10 of the present invention. The club head 10 is a conventional peripheral weighted iron type club head including a heel 12, toe 14, hosel 16, and ball striking face 18 having a loft angle of at least 12 degrees and a complementary rear face 20. The club head 10 has a center of percussion CP shown on the ball striking face 18. As in known in the art, the center of percussion is located at approximately the center of the club head, the exact position being precisely controlled by the weight distribution on the club head itself. The center of percussion represents the spot where a ball would ideally be struck to provide maximum distance and control. In this embodiment, the club head 10 includes a rear recess or cavity 22 which is defined by a peripheral mass 24 which distributes the weight of the club head around the periphery of the golf club head as illustrated particularly in FIG. 2. The bottom of the cavity 22 constitutes a rear wall 26 located within the club head as defined by the peripheral mass 24. In this embodiment, a semi-hemispherical concentrated mass weight 28 is positioned on the rear wall 26 approximately at the mid-point of the cavity 22 and located precisely opposite and extending outwardly from the center of percussion CP on the ball striking face 18.

The club head, as designed, is within the normal range of conventional golf club heads by simply removing some of the material and mass from the periphery of the club head which is substantially equal to the material and mass added by the formation of the centrally located concentrated mass weight 28. Therefore, when a golfer swings the club head and strikes a ball at the center of percussion, a more solid feel is produced by concentrating the mass directly behind the center of percussion using the weight mass 28. When a ball is miss hit off the center of percussion, the peripheral mass 24 then transfers additional energy to the ball to produce a more solid feel than conventional perimeter or non-perimeter weighted golf club heads. Thus, the present invention provides the optimum in terms of feel and accuracy when a golf ball is struck not only at the center of percussion, but also off-center toward the periphery of the club head. By maximizing energy transfer to the ball at both of these areas, this produces greater control over the club head with a minimum loss of distance while increasing the feel and stability of the club head as the ball is being struck.

Figure 4:
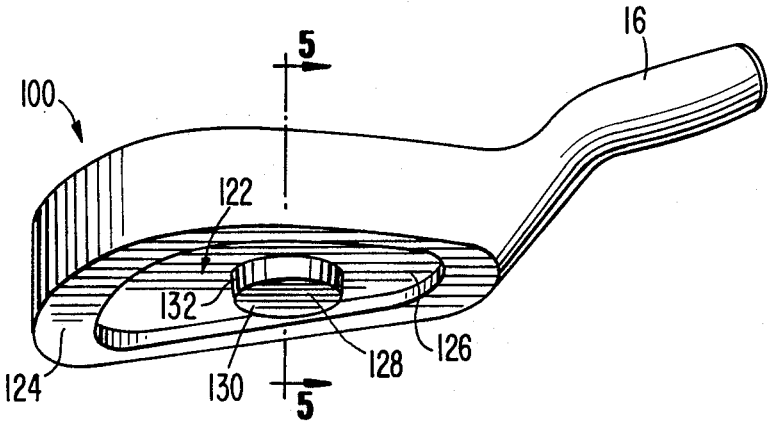
FIG. 4 is a bottom view of a second embodiment of a golf club head in accordance with the present invention.
Figure 5:
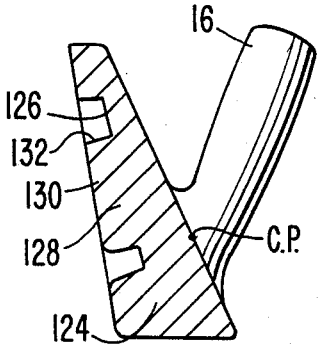
FIG. 5 is a side sectional view taken along the line 5—5 of FIG. 4.

FIG. 4 illustrates a second embodiment of a golf club head 100 of the present invention. In this embodiment, a concentrated mass weight 128 is located on the rear wall 126 of a cavity 122 defined by a rear peripheral mass 124. The concentrated mass weight 128 is cylindrical in shape having a relatively flat top surface 130 and straight annular side wall 132 as illustrated in FIG. 5.

The weight 128 is also located outwardly from and opposite the center of percussion on the club head.

With this embodiment, the concentrated mass weight 128 is located to provide maximum feel and greater accuracy for golf shots when the ball is struck directly at the center of percussion of the cylinder, as well as to minimize the loss of distance and accuracy due to miss hits off the center of percussion using the peripheral mass.

It will be appreciated that the improved golf club head has been described with respect to specific embodiments as shown and changes and modifications may be made without departing from the spirit and scope of the invention as defined by the appended claims. For example, although the club head is formed as an integral unit, the invention contemplates designs in which weight members are fixed to the club head as separate units.

I claim:

1. A weighting system for an iron type golf club head having a loft angle of at least 12 degrees including a hosel, heel, toe, ball striking face, a center of percussion on said ball striking face, and a complementary rear face; the weighting system comprising:

a peripheral mass formed on at least the heel, toe and lower surface portions of the outer periphery of said rear face of the club head;

said peripheral mass defining a cavity centrally located on said rear face of the club head and providing a perimeter weighting for the club head; said cavity having side walls extending outwardly from said complementary rear face; and a centrally located, rounded, concentrated weight member formed completely within said cavity and spaced from said cavity side walls and located on said complementary rear face at said center of percussion; said weight member being further characterized by a raised.surface extending rearwardly from said rear face to substantially in alignment with the rearmost surface the outer of said peripheral mass and in the same direction as said side walls of said peripheral mass, the extremities of said weight member being spaced radially about said center of percussion.

2. The weighting system of claim 1 wherein said weight member is a semi-hemispherical shaped concentrated mass centrally located with respect to said center of percussion.

3. The club head of claim 1 wherein said weight member is a cylindrically shaped concentrated mass having a flat top surface and straight annular side walls, said weight member being centrally located about said center of percussion.

* * * * *